US005323802A

United States Patent [19]

Kiedrowski

[11] Patent Number: 5,323,802

[45] Date of Patent: Jun. 28, 1994

[54] UMBRELLA BAG

[76] Inventor: Rosalie Kiedrowski, 11567 W. Seven Mile Rd., Franksville, Wis. 53126

[21] Appl. No.: 805,436

[22] Filed: Dec. 11, 1991

[51] Int. Cl.[5] ..... A45B 15/00

[52] U.S. Cl. ..... 135/34.2; 383/75; 383/113

[58] Field of Search ..... 135/15.1, 34.2; 2/247, 2/250, 272; 150/151, 154; 383/75, 110, 113, 117

[56] References Cited

U.S. PATENT DOCUMENTS

| | | | |
|---|---|---|---|
| 101,883 | 4/1870 | Johnson | 383/75 |
| 442,991 | 12/1890 | McKevit | 135/34.2 |
| 488,341 | 12/1892 | Vannauker | 135/34.2 X |
| 2,522,604 | 9/1950 | Courter | 135/34.2 |
| 2,563,933 | 8/1951 | Hipps et al. | 383/117 X |
| 3,340,919 | 9/1967 | Holbrook | 383/117 |
| 4,287,607 | 9/1981 | Leach . | |
| 4,388,739 | 6/1983 | Martinon et al. | 383/75 X |
| 4,516,572 | 5/1985 | Schlein . | |
| 5,024,875 | 6/1991 | Hill et al. . | |
| 5,168,589 | 12/1992 | Stroh et al. . | |
| 5,220,950 | 6/1993 | Cordasco . | |

*Primary Examiner*—Carl D. Friedman
*Assistant Examiner*—Lan C. Mai
*Attorney, Agent, or Firm*—Quarles & Brady

[57] ABSTRACT

An umbrella carrying bag employs an inner and outer sleeve. The inner sleeve is water absorbing and air permeable to help capture and disperse water collected on an umbrella after use. The outer sleeve is air permeable and water resistant to prevent the water collected from the umbrella from being transferred to adjacent articles but to allow evaporation of the water from the inner sleeve. The inner sleeve may include an inwardly facing nap having fingers to wipe the surface of the umbrella as it is placed within the bag, further dispersing the water.

5 Claims, 1 Drawing Sheet

UMBRELLA BAG

FIELD OF THE INVENTION

This invention relates generally to carrying bags and more specifically to a carrying bag for an umbrella.

BACKGROUND OF THE INVENTION

The umbrella is a convenient and ubiquitous article of rain gear. When used in conjunction with a raincoat, it is preferable to hoods or hats in that it provides a relatively broad area of protection without disturbing the user's hair. For light rains, an umbrella alone may provide sufficient protection, obviating the need for a bulky raincoat.

With the advent of foldable umbrellas, those with telescoping handles so as to collapse into a folded state, the umbrella has become the rain gear of choice for commuters. The small size of the foldable umbrella is valuable for commuters who face unpredictable weather for short periods in connecting between otherwise protected modes of transportation. The folded umbrella is convenient to carry and may often be stored in a briefcase or purse.

Despite their obvious advantages, umbrellas have always presented a problem when wet. The preferable method of dealing with wet umbrellas, if space allows, is to place them open in a protected area until they dry. Where space constraints or large numbers of umbrellas prevent such an approach, umbrellas may be put in an umbrella stand, point down, to drain and dry.

Neither option is generally available to users of folding umbrellas, the very existence of such umbrellas contemplating continued portability when wet, either to be placed within a car or on a bus or train after folding. Opening an umbrella to dry, or the use of an umbrella stand, in a car, bus or train is clearly impractical.

Generally, all umbrellas, folding or otherwise, come with a sleeve of a water repellent material similar to that used in the umbrella itself. Such sleeves are intended to protect the umbrella from abrasion and dirt and serve only imperfectly for use in storing a wet umbrella. Frequently, a wet umbrella stored in such a sleeve will remain wet and will drop water on the user when the umbrella is removed and reopened. Worse, the sleeve may allow water to saturate the water resistant fabric of the umbrella in a way that allows water to pass through its surface the next time it is used. Nor are such sleeves entirely successful in preventing the water from the umbrella from leaking outward to dampen articles or clothing adjacent o the thus enclosed umbrella.

SUMMARY OF THE INVENTION

The present invention provides a storage bag for an umbrella, particularly in the wet state, that reduces the amount of water leakaging from the wet umbrella to adjacent articles while aiding in the drying of the umbrella through controlled evaporation.

Specifically, the bag employs a first and second sleeve, the first sleeve being constructed of an air permeable, water absorbing material, closed at one end and open at the other end to receive the umbrella in a folded position and hold it therein. The second sleeve surrounds the first sleeve having a corresponding closed and open end, and is of an air permeable, water-repellant material.

It is one object of the invention to provide controlled evaporation of water on a wet umbrella in a storage bag without releasing liquid water to the environment outside of the bag. The water absorbing layer serves to draw the water off of the umbrella and to trap liquid water among the fibers of the inner sleeve to be held tightly by capillary action until their evaporation. The outer water resistant layer prevents the dispersal of this liquid water from the water absorbing layer to other adjacent absorbent articles, such as papers or clothing.

It is yet another object of this invention to promote the rapid drying of the umbrella. The absorbing action of the water absorbing sleeve conducts the liquid water to a larger evaporation area thus promoting drying of the umbrella. The water resistant sleeve permits the flow of air to aid in this process.

In one embodiment, the inner sleeve is constructed with a protruding internal nap having fingers of absorbing material that may interdigitate with the convolutions of the folded umbrella material to draw water into the water absorbing layer and to wipe the surface of the umbrella as it is inserted into the bag. A strap may be attached to the open end of the bag to orient the umbrella in an apex downward position when it is being carried to encourage the natural drainage of the umbrella to its point. The confluence of droplets on the umbrella caused by this orientation and geometry promote water flow off of the umbrella into the absorbent material at the closed end of the umbrella bag.

Foregoing and other objects and advantages of the invention will appear from the following description. In the description, references made to the accompanying drawings which form a part hereof in which there is shown by way of illustration, a preferred embodiment of the invention. Such embodiment does not necessarily represent the full scope of the invention, however, and reference must be made therefor to the claims herein for interpreting the scope of the invention.

DETAILED DESCRIPTION OF THE PREFERRED EMBODIMENT

Figure 1:
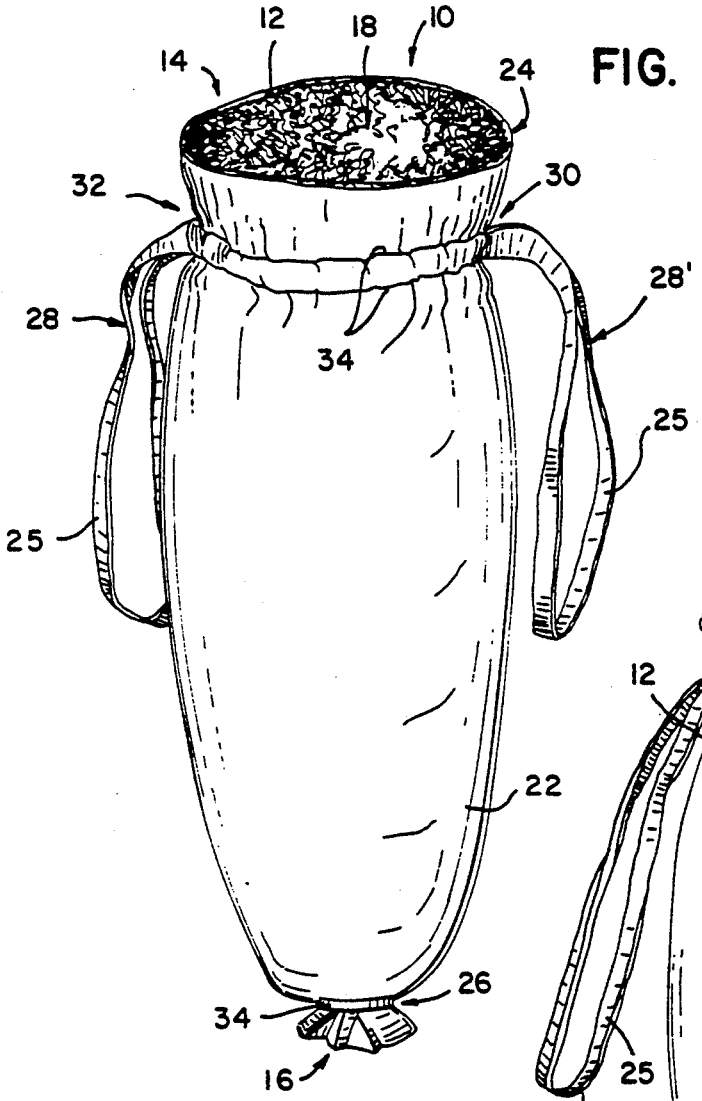
FIG. 1 is a perspective view of the bag of the present invention opened prior to insertion of an umbrella and in the orientation maintained when it is carried by the straps at its upper end.

Referring to FIG. 1, the umbrella storage bag 10, of the present invention includes an inner sleeve 12, generally tubular in shape and having a first open end 14, and a second closed end 16, to form a volume 18, for receiving a folded umbrella 20 (shown in FIG. 2) within its confines. The inner sleeve 12, is constructed of a water absorbing material, such as cotton, characterized by its ability to wick liquid water into its fibers and to retain that water against mechanical dislodging. The inner sleeve 12 includes a plurality of pores (not shown) to permit the passage of air therethrough. A woven 100% cotton material such as terry cloth satisfies these requirements.

Coaxially surrounding the inner sleeve 12 is an outer sleeve 22 having generally the same tubular form as the inner sleeve 12. The outer sleeve 22 has a corresponding open end 24 adjacent to the open end 14 of the inner sleeve 12 and a corresponding closed end 26 adjacent to the closed end 16 of the inner sleeve 12. The outer sleeve 22 is constructed of a air permeable, water repellant material, such as a 2.5 ounce, seventy denier woven nylon, to resist the passage of liquid water through its surface but to provide a degree of air flow so that air may reach the inner sleeve 12.

Straps 28 and 28' are attached diametrically on either side of the open end 24 of the outer sleeve 22 so as to suspend the umbrella storage bag generally vertically, with the open ends 14 and 24 of the inner sleeve 12 and outer sleeve 22 above the closed ends 16 and 26 of the inner sleeve 12 and outer sleeve 22.

In one embodiment, the straps 28 and 28' may be a single continuous loop of tape 25 threaded through a first opening 30 in the outer sleeve 22 near its open end 24 and passing between the outer sleeve 22 and the inner sleeve 12 around to a second opening 32 diametrically opposed to the first opening 30. The tape 25 passes out of the second opening 32 and back into second opening 32 to create a loop forming the strap 28 and then passes in a clockwise direction between the material of the outer sleeve 22 and inner sleeve 12 to pass out of first opening 30 to provide a loop of a second strap 28'. The tape 25 then continues in a clockwise direction between the inner and outer sleeves 12 and 22 to join with its other end.

It will be understood that this method of creating the straps 28 and 28' and attaching them to the outer sleeve 22 provides a means for constricting the open ends 24 and 14 of the outer and inner sleeves 22 and 12 to close the storage bag 10. This constriction is accomplished by retracting the tape 25 of the handles 28 and 28' from the respective openings 30 and 32. Alternatively, the tape 25 of one strap 28 or 28' may be preferentially withdrawn from its associated opening 30 or 32' to constrict the open ends 14 and 24 of the inner sleeve 12 and outer sleeve 22 and to provide a single longer strap 28 or 28' as may be convenient.

The open end 14 of the inner sleeve 12 is attached to the open end 24 of the outer sleeve 22 so that they open or close together under the influence of the compression of tape 25 acting about the circumference of the open ends 14 and 24. The tape 25 as passing between the material of the inner sleeve and the outer sleeve 12 and 22 may be guided by stitching 34 serving to attach the inner sleeve 12 to the outer sleeve 22 on either side of the tape 25 and to form a channel.

The closed ends 16 and 26 of the inner sleeve 12 and outer sleeve 22 need not be connected to each other but may be closed separately. This aids in assembly of the storage bag 10 by allowing preclosure of the closed end 16 of the inner sleeve 12 prior to assembly of the inner sleeve 12 with the outer sleeve 12 with the outer sleeve 16 thus avoiding the problem of accessing the closed end 16 of the inner sleeve 12 once the inner sleeve 12 is attached to the outer sleeve 22. The outer sleeve 22 may be closed by means of a constricting band 34 placed around the closed end 26 of the outer sleeve 22 to draw it tightly together.

The inner sleeve 12 is closed with a butt hem substantially perpendicular to the axis of the sleeve to ensure ample material at the closed end 16 to absorb water preferentially directed to the closed end 16 as will be described.

Figure 2:
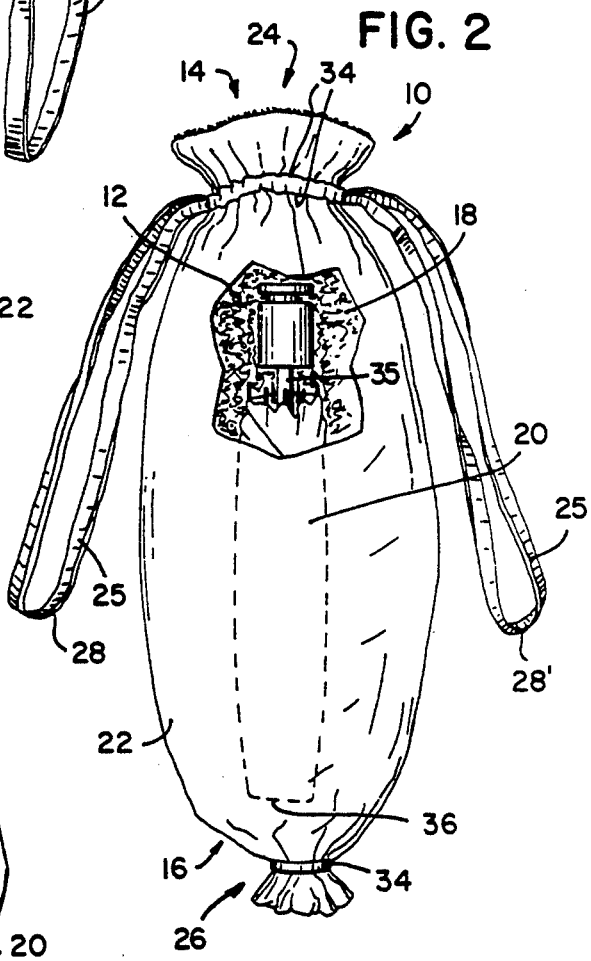
FIG. 2 is a perspective cutaway view of the bag of FIG. 1 showing placement of the umbrella within the bag.

Referring now to FIG. 2, an umbrella 20 may be inserted into the umbrella storage bag 10 with its shaft 35 oriented generally along the axis of the tube of the inner sleeve 12 and with its apex 36 entering the open end 14 of the inner sleeve 12 first so as to orient the umbrella 20 with its apex 36 positioned closest to the closed end 16 of the inner sleeve. The infundibuliform shape of the folded umbrella 20 focuses draining water toward its apex 36 to be absorbed in the material of the closed end 16. This focussing is encouraged as the confluence of droplets is thought to speed their drainage.

Figure 3:
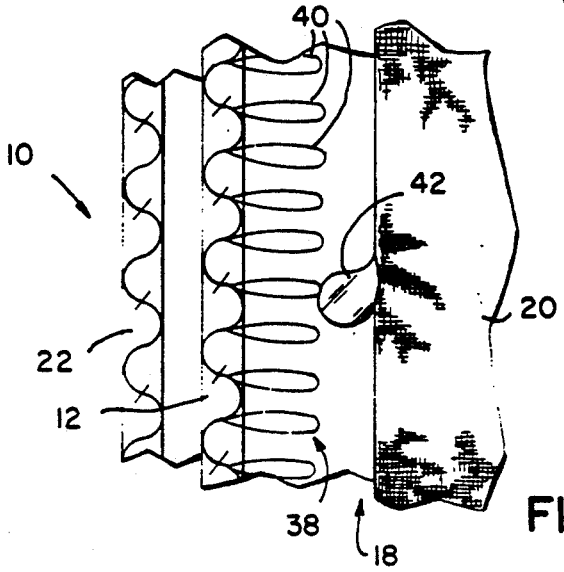
FIG. 3 is a cross sectional view through one wall of the bag showing the absorbing and water resistant layers of the invention and showing the orientation of the water absorbing nap in proximity to an umbrella having surface water.

Referring now to FIG. 3 the material of the inner sleeve 12 may include a nap 38 comprised of a plurality of water absorbing fingers 40 directed inward to the volume 18 to contact the surface of the folded umbrella 20 when it is inserted into the umbrella storage bag 10 as described above. The fingers 40 wipe the surface of the umbrella 20 increasing the probability of contact of the absorbing material of the inner sleeve 12 with surface moisture 42 to further aid in dispersing the surface moisture 42 from the umbrella 20.

The inner and outer sleeves 12 and 22 have a diameter larger than the folded radius of the umbrella 20 so that the material of the inner sleeve 12 and the outer sleeve 22 may convolve and conform somewhat with the folded fabric of the umbrella 20 thus further aiding in drawing surface moisture 42 from the umbrella 20 and further increasing the evaporative area over which the surface moisture is spread when absorbed by the inner sleeve 12.

It will be understood that even when the open end 14 and 24 are closed by the tape 25 of the straps 28 that evaporation of the surface moisture 42 may occur by means of air admitted through the air permeable surfaces of the inner and outer sleeves 12 and 22. Nevertheless, the water repellant nature of the outer sleeve 22 prevents the passage of liquid water from the umbrella 20 or the inner sleeve 12 out of the umbrella storage bag 10 to dampen adjacent articles. The water repellant nature of the material of the outer sleeve 22 also helps prevent dirt from adhering to the outer sleeve 22 or passing through the outer sleeve 22 to soil the inner sleeve 12 or the umbrella 20. Thus, the umbrella 20 may dry without the risk of its surface moisture 42 collecting dirt from the air or the environment. Preserving the cleanliness of the fabric of the umbrella 20 protects its water repellant nature.

Many modifications and variations of the preferred embodiment which will still be within the spirit and scope of the invention will be apparent to those with ordinary skill in the art. For example, the method of closing the ends of the inner and outer sleeve may be selected among well-known manufacturing processes. Although cotton and nylon are preferred for the materials of the inner and outer sleeve, other materials woven or non-woven having the required properties of air permeability and water absorptivity or resistance as the case may be, may be used. In order to apprise of the various embodiments that may fall within the scope of the invention, the following claims are made.

I claim:

1. A bag for an umbrella, the umbrella being of a type having a flexible waterproof material attached to a plurality of ribs extending from an apex to attach to one end of an umbrella shaft, the ribs folding, when the umbrella is folded, to a position substantially parallel to the umbrella shaft to fit within a cylindrical volume having a folded radius, the bag comprising:

a first sleeve sized to substantially conform to the dimensions of the umbrella when folded and constructed of an air permeable, water absorbing material, the sleeve closed at one end and opened at the other end for receiving the folded umbrella and holding it therein for absorbing water therefrom; and a second sleeve positioned coaxially about the first sleeve, the second sleeve being constructed of an air permeable, water repellent material, having a closed end adjacent to the closed end of the first sleeve and an opened end adjacent to the open end of the first sleeve for permitting insertion of the umbrella into the first sleeve when the second sleeve is so positioned around the first sleeve for allowing evaporation of water through the second sleeve from the first sleeve.

2. The bag as recited in claim 1, wherein the air permeable, water absorbing material includes a water absorbing nap comprised of a plurality of water absorbing fingers extending inward from the first sleeve to contact the umbrella when the umbrella is inserted in the first sleeve.

3. The bas as recited in claim 1, wherein the first sleeve has a circumference substantially larger than a circumference of the cylindrical volume having the folded radius so that the first sleeve may convolve with the waterproof material of the umbrella when the umbrella is inserted into the inner sleeve.

4. The bas as recited in claim 1, including a strap attached to an open end of the second sleeve to suspend the bag so that the apex of the umbrella, when the umbrella is inserted apex first into the first sleeve, points downward.

5. The bas as recited in claim 4 wherein the closed end of first sleeve concludes in a surplus of water absorbing material to absorb a confluence of water draining from the umbrella toward the apex of the umbrella.

* * * * *

UNITED STATES PATENT AND TRADEMARK OFFICE

CERTIFICATE OF CORRECTION

PATENT NO. : 5,323,802

DATED : June 28, 1994

INVENTOR(S) : Rosalie Kiedrowski

It is certified that error appears in the above-identified patent and that said Letters Patent is hereby corrected as shown below:

| | |
|---|---|
| Col. 1, line 51 | "adjacent o the thus" should be -- adjacent of the thus --. |
| Col. 6, line 5 (Claim 3) | "The bas" should be -The bag -. |
| Col. 6, line 12 (Claim 4) | "The bas" should be -- The bag --. |
| Col. 6, line 17 (Claim 5 | "The bas" should be -- The bag --. |

Signed and Sealed this

Sixth Day of September, 1994

*Attest:*

*Attesting Officer*

Bruce Lehman

BRUCE LEHMAN

*Commissioner of Patents and Trademarks*